United States Patent [19]

Lee

[11] 4,268,918

[45] May 26, 1981

[54] NOVELTY CAP

[76] Inventor: Lois E. Lee, 1917 Oregon St., Berkeley, Calif. 94703

[21] Appl. No.: 143,946

[22] Filed: Apr. 25, 1980

[51] Int. Cl.[3] ..... A42B 1/24

[52] U.S. Cl. ..... 2/199; 46/1 F; 46/123; 46/124; 273/DIG. 17

[58] Field of Search ..... 2/199, 185 R, 206; 46/1 F, 123, 124, 119, 120; 272/8 N; 273/DIG. 17; D2/248, 250

[56] References Cited

U.S. PATENT DOCUMENTS

| | | | |
|---|---|---|---|
| D. 174,517 | 4/1955 | Schwartz | D2/248 |
| D. 214,015 | 5/1969 | Hicks | D2/248 |
| D. 246,617 | 12/1977 | Tomlin, Jr. | D2/250 |
| 1,601,983 | 10/1926 | Savage | 46/123 |
| 1,618,517 | 2/1927 | Cureton | 46/1 F |
| 2,840,377 | 6/1958 | Jenks | 46/123 X |

FOREIGN PATENT DOCUMENTS

| | | | |
|---|---|---|---|
| 2335456 | 1/1975 | Fed. Rep. of Germany | 46/124 |

*Primary Examiner*—Peter P. Nerbun

*Attorney, Agent, or Firm*—Robert Charles Hill

[57] ABSTRACT

A novelty cap suitable for use as a head covering is provided with the appearance of one of a family of animals. The caps are all provided with at least one movable animal feature which a wearer of the cap may selectively operate by pulling on string connectors looped underneath the cap wearer's chin.

5 Claims, 9 Drawing Figures

FIGURE 5
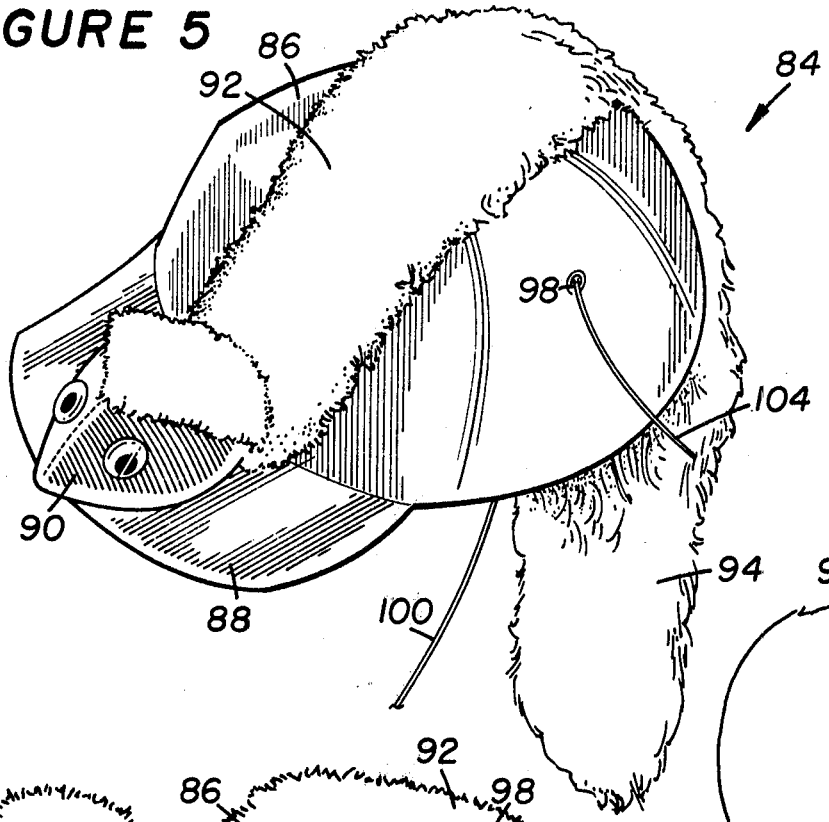
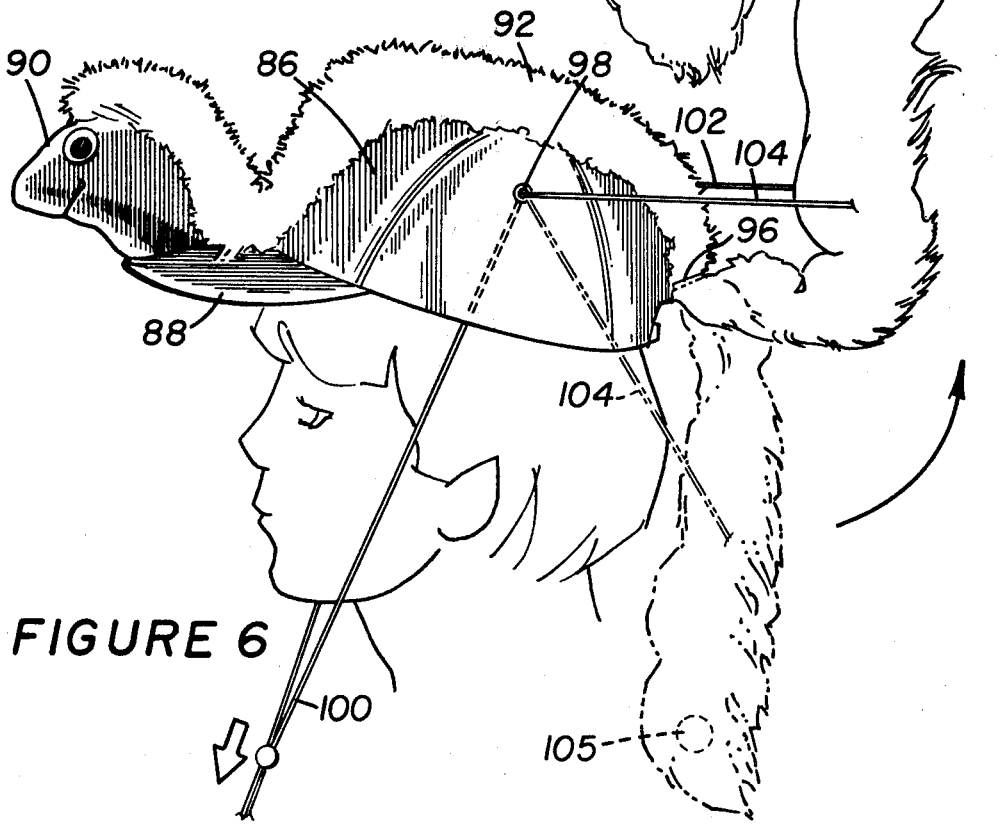
FIGURE 6

NOVELTY CAP

BACKGROUND OF THE INVENTION

A novelty cap fits on the head of the wearer and can be activated to move various animal features provided therewith.

SUMMARY OF THE INVENTION

This invention relates to novelty caps of the kind adapted to be worn by children or adults.

The caps can be worn by children at parties such as birthday parties, etc.

The caps can be worn by adults at costume parties or at athletic events.

More specifically the novelty caps of the present invention take the form of various members of the animal family.

A unique construction of the novelty caps of the present invention is that they are provided with at least one selectively movable animal feature. This unique construction makes the novelty caps appear more lifelike and provides an element of surprise at the disposal of a wearer of the cap.

It is the primary object of the present invention to provide a new and improved novelty cap.

Another object is to provide a cap having at least one selectively movable animal feature thereon.

Other objects and advantages of the novelty cap of the present invention will become more apparent from the following specification and claims.

BRIEF DESCRIPTION OF THE DRAWINGS

FIG. 5 is a top perspective view of yet another preferred embodiment of the invention wherein the novelty cap takes the form of a skunk.

FIG. 6 is a side perspective view of the embodiment illustrated in FIG. 5.

DESCRIPTION OF THE PREFERRED EMBODIMENTS

Figure 1:
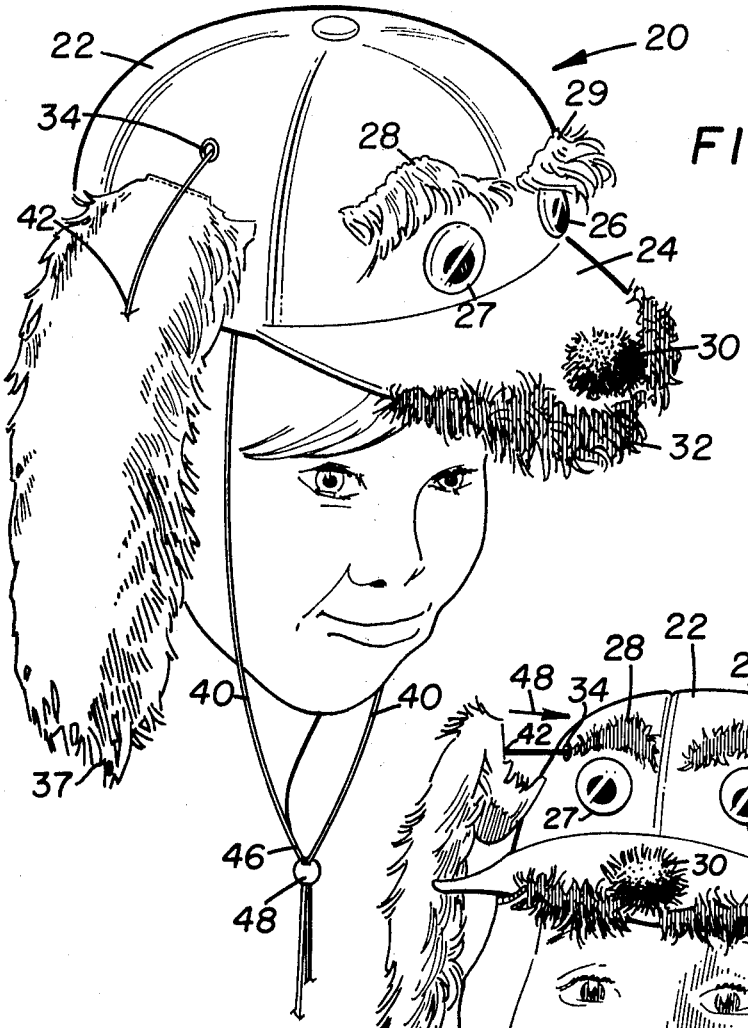
FIGS. 1 and 2 are perspective views illustrating one preferred embodiment of the invention wherein the novelty cap takes the form of a dog.
Figure 2:
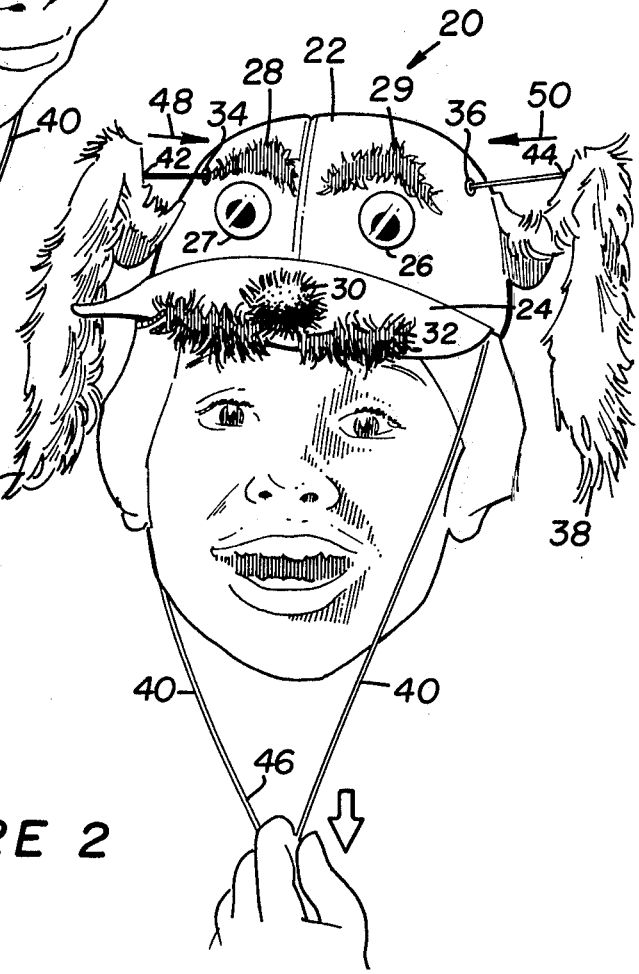

Referring to FIGS. 1 and 2, one preferred embodiment of the novelty cap of the present invention is illustrated as taking the form of a dog.

The novelty cap, shown generally at 20, comprises a domeshaped crown portion 22 which is provided with a forwardly extending brim 24 located on the lower front end of the cap. The crown portion 22 is provided with stationary dog features secured thereto, such as dog eyes 26 and 27 together with eyebrows 28 and 29, all located on the front of the crown above the brim 24.

The brim is also preferably provided with stationary dog features, such as a dog nose 30 and whiskers 32.

Two small holes 34 and 36 are provided on the cap as shown. The hole 34 is located midway up the cap dome 22 on one side of the cap brim 24 and the hole 36 is similarly located midway up the cap dome on the opposite side of the cap brim. The function of these holes will become apparent from the following description.

The most important feature of the dog cap embodiment comprises the downwardly extending, flexible dog ears shown at 37 and 38. The ears 37 and 38 are preferably about 6 inches in length and constructed of a shaggy fabric for a realistic appearance. Dog ears 37 and 38 have their upper ends fixedly secured to the cap dome 22 at a location below the respective holes 34 and 36.

A string connector 40 has its outer portions 42 and 44, respectively, connected to the outer surface of the dog ears 37 and 38 at approximately the middle area of the dog ears. The string connector means 40 extends through each of the holes 34 and 36 downwardly below the cap to form a loop 46 at the lower portion thereof. The loop 46 may be adjustable by means of a slide member 48 so that the loop may easily fit under the chin of a cap wearer as shown in FIG. 2.

The wearer of the cap can attract considerable attention by pulling and releasing the string loop 46 which causes the dog ears to move upwardly and downwardly with a flapping motion. Because the dog ears are flexible and because the outer end portions 42 and 44 of the string are attached to the middle area of the dog ears, the flapping motion is created as the string ends move in the direction of arrows 48 and 50 causing the ears to move both outwardly and upwardly.

Figure 3:
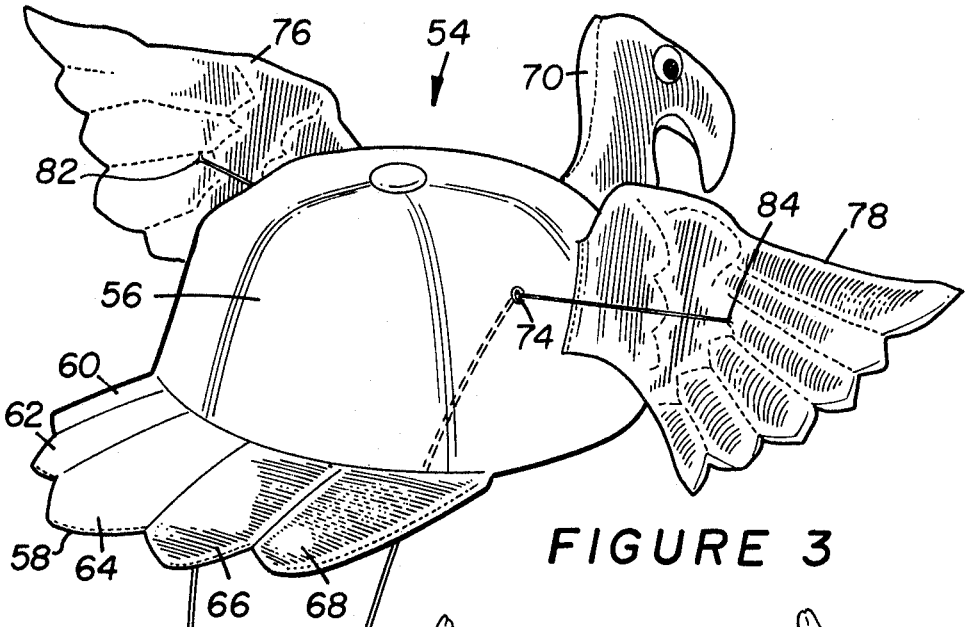
FIGS. 3 and 4 are perspective views taken from the side and top, respectively, and illustrating another preferred embodiment of the invention wherein the novelty cap takes the form of a bird.
Figure 4:
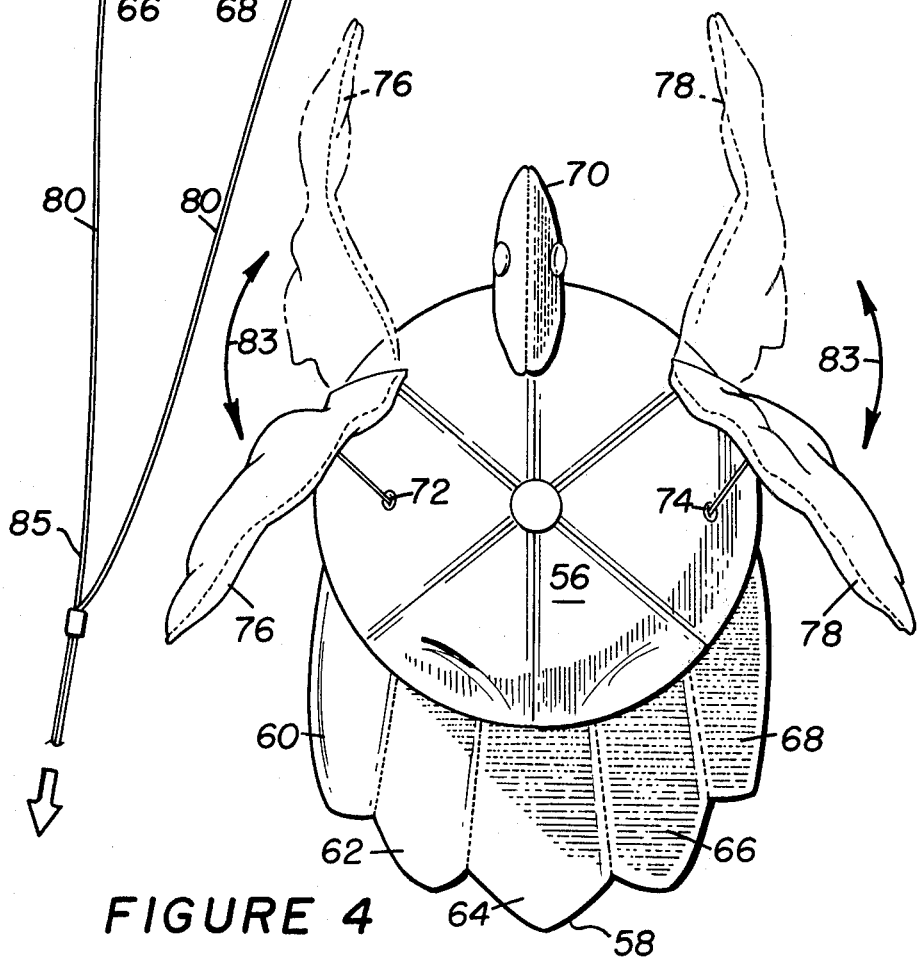

Referring now to FIGS. 3 and 4, another preferred embodiment of the novelty cap of the present invention is illustrated as taking the form of a bird.

As in the previous embodiment, the cap shown generally at 54 comprises a dome-shaped crown portion 56 which is provided with a forwardly extending brim 58.

A unique feature of the bird cap is that the brim 58 is formed with ribbed portions 60, 62, 64, 66 and 68 so that the brim resembles the tail of a bird.

The rear of the cap is provided with a stationary bird head 70 and the cap is designed to be reversible so that the wearer of the cap may wear it with the bird head 70 pointing forward or rearward.

As with the previous embodiment, the cap is provided with two small holes 72 and 74 located midway up the cap dome 56 and on opposite sides of the cap brim 58.

The most important feature of the bird cap embodiment comprises the bird wings 76 and 78. The bird wings are preferably constructed of a padded fabric and are relatively stiff. The bird wings 76 and 78 have their inner ends hingedly secured to the cap dome 56. The inner ends 76 and 78 of the bird wings should be hinged on an inclined angle toward the bird head so that the wings tend to flop toward the bird head 70 under the influence of gravity.

As shown in FIGS. 3 and 4, the inner ends of the bird wings are hingedly secured on an inclined angle at a location midway between the bird head 70 and each of the small holes 72 and 74.

A string connector 80 has outer end portions 82 and 84, respectively, connected to the bird wings 76 and 78 at approximately the middle area thereof. The string connector extends through each of the holes 72 and 74 down through the inside of the hat to form an adjustable lower loop which can easily fit below a cap wearer's chin as previously discussed.

When the cap wearer wishes to attract attention, the string loop 85 is pulled and released causing the bird wings to flop backwardly and forwardly as indicated by arrows 83.

Referring now to FIGS. 5 and 6, yet another preferred embodiment of the novelty cap of the present invention is illustrated as taking the form of a skunk.

As in the previous embodiments, the cap generally indicated 84 comprises a dome-shaped crown portion 86 which is provided with a forwardly extending brim 88. The brim 88 is provided with a stationary skunk head 90 mounted thereon. A stationary skunk body 92 constructed of a fluffy fabric material extends from the skunk head 90 up and over the centermost top portion of the cap crown 86 to the rear of the cap.

A flexible and very fluffy skunk tail 94, preferably about one foot in length, is hingedly secured at 96 to the rear of the cap so as to extend downwardly therefrom.

As with the previous embodiments, the cap is provided with two small holes located midway up the cap dome 86 and on opposite sides of the brim 88. Only one of these holes 98 is shown in the drawing.

A string connector 100 has outer end portions 102 and 104 connected, respectively, to each side of the skunk tail 94 beyond the longitudinal midpoint thereof.

Because of the hinged connection at 96 and the location of the connection points of the outer end portions 102 and 104 of string connector to the skunk tail, a unique motion may be imparted to the skunk tail by the wearer of the skunk cap. When the cap wearer pulls downwardly on the string connector 100 as shown in FIG. 6, the skunk tail 94 swings outwardly from the rear of the cap and simultaneously flexes upwardly in the middle portion of the tail. Releasing the string connector 100 causes the tail to return to its downwardly extending position as shown in FIG. 5, concealed weight 105 helping the return.

Figure 7:
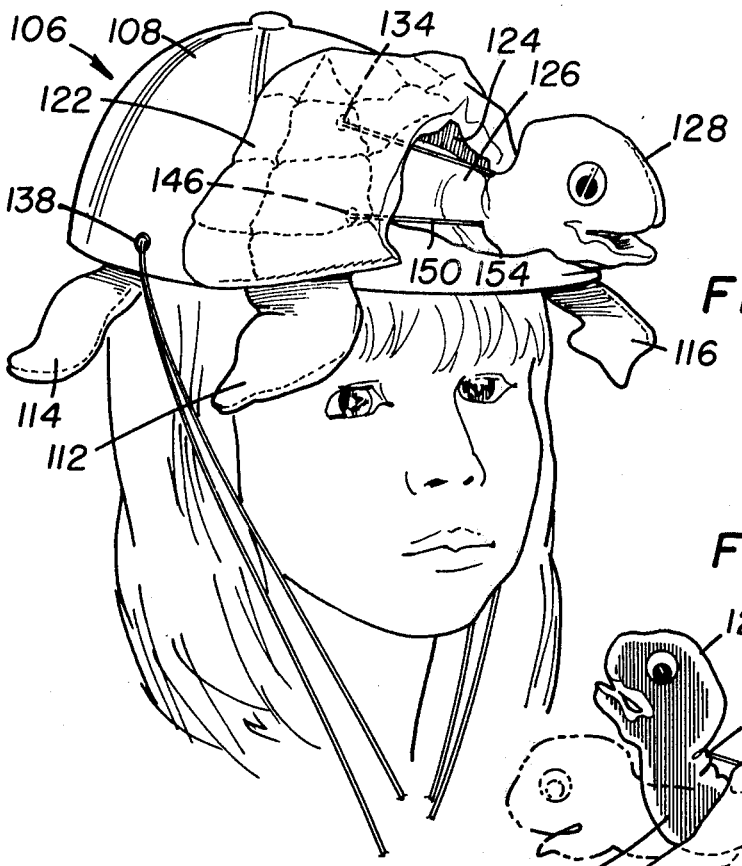
FIG. 7 is a front perspective view of still another embodiment of the invention wherein the novelty cap takes the form of a turtle.
Figure 8:
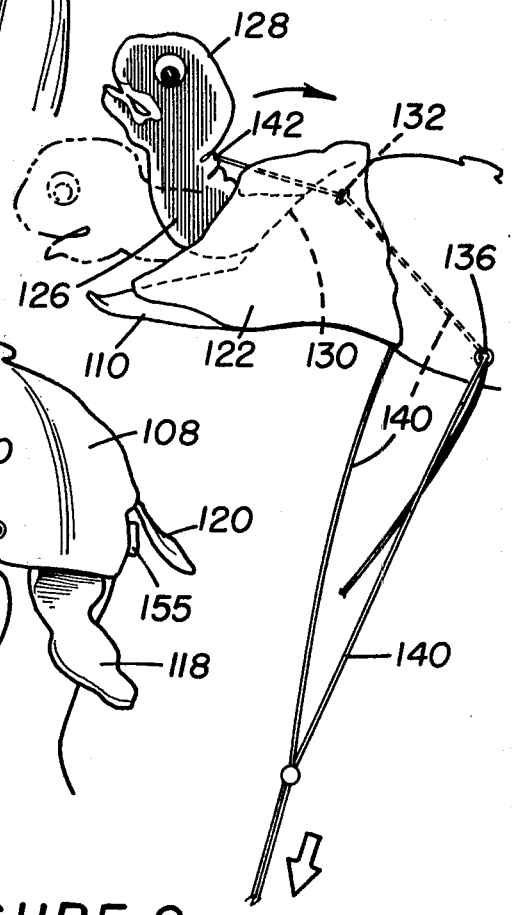
FIG. 8 is a side view of the embodiment shown in FIG. 7 illustrating one form of movement of a turtle head.
Figure 9:
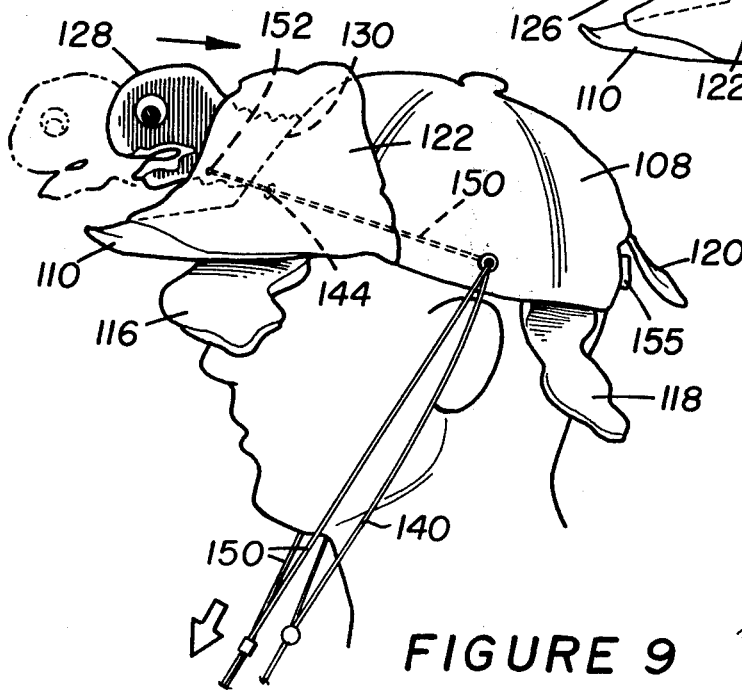
FIG. 9 is a side view of the embodiment shown in FIG. 7 illustrating another form of movement of a turtle head.

Referring now to FIGS. 7, 8 and 9, still another preferred embodiment of the novelty cap of the present invention is illustrated as taking the form of a turtle.

As in the previous embodiments, the cap generally indicated at 106 comprises a dome-shaped crown portion 108 which is provided with a forwardly extending brim 110.

Stationary, flexible fabric turtle feet are attached to the hat as shown at 112, 114, 116 and 118. A turtle tail 120 is attached to the rear of the cap. A stationary turtle shell 122 extends from the cap brim 110 up over the front crown portion of the cap as shown. An opening 124 is provided in the front of the turtle shell.

A flexible turtle neck 126 having a turtle head 128 at the outer end thereof is hingedly secured at 130 to the front portion of the cap crown 108. The hinged connection 130 allows the turtle neck to move upwardly and downwardly. The turtle neck 126 is formed of a stuffed elongated fabric which is compressible in a longitudinal direction for a unique movement which will be hereinafter described.

Referring to FIG. 8 in conjunction with FIG. 7, a pair of holes 132 and 134 are provided in the cap crown 108 underneath the turtle shell 122 on opposite sides of the turtle head 128 and at a location above the hinged connection 130. Another pair of holes 136 and 138 are provided on lower opposite sides of the cap crown 108.

A first string connector 140 has its two outer ends connected to the top of the turtle neck just behind the turtle head at 142. The string connector 140 then extends inside the cap through holes 132 and 134, then outside the cap through holes 136 and 138.

When a cap wearer pulls downwardly on the lefthand side of string connector 140, the turtle head moves upwardly to the left. Pulling downwardly on the righthand side of the string connector 140 causes the turtle head to move upwardly to the right. Pulling straight down at the bottom looped portion of string connector 140 causes the turtle head to move straight upwardly.

Referring to FIG. 9 in conjunction with FIG. 7, a pair of holes 144 and 146 are provided in the cap crown 108 underneath the turtle shell 122 on opposite sides of the turtle head 128 and at a location below the hinged connection 130.

A second string connector 150 has its two outer ends 152 and 154 connected on opposite sides of the turtle neck 126 just below the turtle head 128. The string connector 150 then extends inside the cap through holes 144 and 146, then outside the cap through holes 136 and 138.

When a cap wearer pulls downwardly on the lefthand side of string connector 150, the turtle head moves horizontally to the left. Pulling downwardly on the righthand side of string connector 150 causes the turtle head to move horizontally to the right. Pulling straight down at the bottom looped portion of string connector 150 causes the turtle head to move inwardly into the shell while releasing causes the turtle head to move outwardly of the turtle shell.

FIG. 9 shows an adjustible length strap 155 which is a common feature to all of the caps described in the various embodiments. The adjustable length strap 155 allows the cap to accommodate various head sizes as is well understood by those skilled in the art.

It will be obvious that numerous modifications and variations are possible for the above described novelty caps 20, 54, 84 and 106 within the scope of the present invention. The foregoing description, as setting forth various constructional and operational details for purposes of understanding only, is not to be taken as limiting the scope of the present invention which is defined only by the following claims.

I claim:

1. A novelty cap comprising:

a dome-shaped crown portion whose major diameter is adjustable to fit various head sizes;

a forwardly extending brim located on a front end of the cap;

a first pair of small holes, each of which is located midway up the cap dome on opposite sides of the cap brim;

at least one movable animal feature directly integral with the outer surface of the cap crown portion;

first string connector means having outer end portions connected to the movable animal features;

said string connector means extending through the first pair of holes and downwardly below the cap to form a first loop which can easily fit under the chin of a wearer of the cap;

whereby the wearer of the cap can cause movement of the animal features by pulling and releasing the string loop.

2. The invention of claim 1 wherein the movable animal features comprise:

a pair of downwardly extending flexible dog ears having their first ends fixedly secured to said cap dome at a location below the first pair of holes;

and wherein the outer end portions of said string means are connected to said dog ears at approximately the middle area thereof; whereby a wearer of the cap can cause the dog ears to move upwardly and downwardly with a flapping motion by pulling and releasing the string loop.

3. The invention of claim 1 wherein the novelty cap takes the form of a turtle, said cap comprising:

a pair of stationary front turtle legs each mounted on opposite sides of the cap brim;

a pair of stationary rear turtle legs mounted on opposite sides of the lower rearward portion of the cap;

a stationary turtle tail mounted on the lower rearmost portion of the cap;

said movable animal feature comprising a compressible, elongated, flexible turtle neck and head portion extending from the front of the cap forwardly out over the cap brim;

a second pair of small holes, each of which is located below a corresponding hole comprising said first pair of small holes;

a third pair of small holes, each of which is located on a lower opposite side of the cap brim and at a location rearwardly of the first and second pairs of holes;

a stationary turtle shell portion having a central opening through which said turtle head projects;

said turtle shell attached to the cap brim and the cap dome in a manner which covers the first and second pairs of holes from view;

first string connector means having outer end portions connected to the top of said turtle neck just behind the turtle head;

said first string connector means extending through the first pair of holes and then through the third pair of holes;

whereby a wearer of the cap can cause the turtle head to move upwardly and downwardly by pulling and releasing the first string loop;

second string connector means having outer end portions, each end portion connected to an opposite side of the turtle neck just below the turtle head;

said second string connector means extending through said second pair of holes and then through said third pair of holes downwardly below the cap to form a second loop which can easily fit under the chin of a cap wearer;

whereby a cap wearer can cause the turtle head to move rearwardly and forwardly by pulling and releasing the second string loop.

4. A novelty cap in the form of a skunk comprising:

a dome-shaped crown portion whose major diameter is adjustable to fit various head sizes;

a forwardly extending brim located on a front end of the cap and having a stationary skunk head thereon;

a stationary skunk body portion extending from the brim up over the crown to the rear of the cap;

a pair of small holes, each of which is located midway up the cap dome on opposite sides of the cap brim;

a downwardly extending flexible skunk tail hingedly secured to a lower portion of the rear of the cap;

first string connector means having outer end portions each connected to a side of the skunk tail beyond the longitudinal midpoint thereof;

said string connector means extending through the first pair of holes and downwardly below the cap to form a first loop which can easily fit under the chin of a wearer of the cap;

whereby the wearer of the cap can cause the skunk tail to swing outwardly away from the rear of the cap and simultaneously flex upwardly in the middle portion of the tail by pulling and releasing the string loop.

5. A reversibly worn novelty cap in the form of a bird comprising:

a dome-shaped crown portion whose major diameter is adjustable to fit various head sizes;

a stationary bird head located on the rear of the cap;

a forwardly extending brim located on a front end of the cap and shaped in the form of a bird tail;

a pair of small holes, each of which is located midway up the cap dome on opposite sides of the cap brim;

a pair of stiff bird wings, each wing having its first end hingedly secured on an inclined angle to said cap dome, and at a location midway between said bird head and one of said holes;

first string connector means having outer end portions connected to said bird wings at approximately the middle area thereof;

said string connector means extending through the first pair of holes and downwardly below the cap to form a first loop which can easily fit under the chin of a wearer of the cap;

whereby the wearer of the cap can cause the bird wings to flop backwardly and forwardly by pulling and releasing the string loop.

* * * * *